US007597039B2

(12) United States Patent
Stussak et al.

(10) Patent No.: US 7,597,039 B2
(45) Date of Patent: Oct. 6, 2009

(54) BELT BAGS FOR FIREARMS

(75) Inventors: Martin Stussak, Oberndorf/Schornberg (DE); Thomas Kopf, Oberndorf (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 11/753,913

(22) Filed: May 25, 2007

(65) Prior Publication Data

US 2008/0092728 A1 Apr. 24, 2008

Related U.S. Application Data

(63) Continuation of application No. PCT/EP2005/012490, filed on Nov. 22, 2005.

(30) Foreign Application Priority Data

Nov. 25, 2004 (DE) ..... 10 2004 057 008

(51) Int. Cl.
*F41A 9/79* (2006.01)
*F41A 9/34* (2006.01)

(52) U.S. Cl. ..... 89/34; 89/33.14

(58) Field of Classification Search ..... 89/33.14, 89/34; 42/98

See application file for complete search history.

(56) References Cited

U.S. PATENT DOCUMENTS 1,403,623 A * 1/1922 Payne ..... 89/137
1,719,126 A * 7/1929 Pfeiffer et al. ..... 89/33.14
2,705,575 A 4/1955 Hammer
2,866,289 A * 12/1958 Wilcox ..... 42/87
3,153,981 A * 10/1964 Brass ..... 89/33.4
3,293,986 A * 12/1966 Stoner ..... 89/34
4,096,783 A 6/1978 Wallwey et al.
4,389,918 A 6/1983 Peck et al.
4,430,820 A 2/1984 Marsh et al.
5,263,397 A * 11/1993 Sanderson ..... 89/37.22
6,152,012 A 11/2000 Sherwood et al.
6,393,960 B1 5/2002 Bilger
6,675,693 B1 * 1/2004 Heayn ..... 89/34
6,799,500 B1 * 10/2004 Kulikowski ..... 89/34
6,836,991 B1 * 1/2005 Saur ..... 42/98

OTHER PUBLICATIONS

I.V. Hogg, "Jane's Infantry Weapons 1985-1986," Jane's Publishing Company, 1986, 18 pages.
English translation of the International Search Report for international patent application serial No. PCT/EP2005/012490.
English translation of the International Preliminary Report on Patentability for international patent application serial No. PCT/EP2005/012490.

* cited by examiner

*Primary Examiner*—Stephen M Johnson
(74) *Attorney, Agent, or Firm*—Hanley, Flight & Zimmerman, LLC

(57) ABSTRACT

A belt bag for use with a firearm related methods are disclosed. An example belt bag includes a first bag component made of a rigid material and a second bag component. The first bag component and the second bag component are releasably coupled and may pivot with respect to one another between an open, reloading position and a closed position. In addition, an opening of the belt bag is coupled to the firearm adjacent to a belt intake opening of the firearm.

14 Claims, 1 Drawing Sheet

BELT BAGS FOR FIREARMS

RELATED APPLICATIONS

This patent is a continuation of International Patent Application Serial No. PCT/EP2005/012490, filed Nov. 22, 2005, which claims priority to German Patent Application 10 2004 057 008.6, filed on Nov. 25, 2004, both of which are hereby incorporated herein by reference in their entireties.

FIELD OF DISCLOSURE

This disclosure relates generally to firearms, and, more particularly, to belt bags for firearms.

BACKGROUND

The storage, protection and loading of ammunition are concerns with the operation of firearms. One device that is used in response to these concerns is a belt bag. A known belt bag for use with a machine gun is described in U.S. Pat. No. 6,799,500.

Machine guns that have long belts fed into them have the disadvantage that the cartridge belt hangs down unprotected on the outside of the machine gun. Thus, the belt can become dirty and can get caught on various objects or otherwise be damaged. For example with a machine gun for an armored vehicle, if the machine gun is attached relatively high above the bottom of the vehicle, if there is no ammunition loader who holds and guides the belt in his hands, if the belt is too long or if generally a poor quality ammunition is used, then the reloading mechanism of the machine gun may not be able to feed the heavy, low-hanging belt reliably into the machine gun. In this case, the belt may be shortened, additional mechanical feed devices may be attached or a "belt depot" may be created, which is located close to the gun and in which the belt is stored such that the belt may be fed easily.

Such "belt depots" are generally formed from an ammunition crate, and the belt depots form the smallest replenishment unit for belted ammunition. The advantage of such belt depots is that properly packaged ammunition does not need to be unpackaged before the insertion of the belt into the machine gun. Ammunition that is first unpackaged may become contaminated with dirt. However, a disadvantage is that above all else, the construction of the ammunition crate takes into consideration the needs of the replenishment of the ammunition and not those of the machine gun. The belts are inserted for optimal packing density and so the ammunition may be fed into the machine gun from either end. Examples of such ammunition crates, which are used as storage containers for machine gun belts on machine guns or the like, can be found in U.S. Pat. Nos. 6,393,960; 4,096,783; and 2,705,575. Thus, the use of the use of ammunition crates as a means for ammunition stockpiling has prevailed over the alternative design (i.e., extremely large magazines) in the fifty years since the Second World War.

But such ammunition depots, which are formed from the ammunition crates, have other disadvantages as well. For example, rain water, which may flow into the top of an open ammunition crate, may not be drained from the bottom of the crate because there is no hole in the bottom of the crate because such a hole also would let humidity into the crate during transport.

Moreover, such crates also are very heavy and, when the crates are attached to the lateral side of a gun, the additional weight from the crate moves the center of gravity of the gun and the ammunition. Shifting the center of gravity of the gun considerably burdens operation of the gun operation by enabling increased lateral movement of the gun during shooting. This malfunction cannot be corrected by a mount if one wants to enable effortless lateral aiming during shooting.

Thus, a foldable bag has been recently suggested in U.S. Pat. No. 6,675,693 for use with a machine gun. In U.S. Pat. No. 6,675,693 the "belt depot" is formed by a relatively small cloth bag made of nylon fabric, which is attached to the machine gun laterally below the cartridge entrance and provides free access to the reloading device of the machine gun when open. After being inserted into the machine gun, the belt is folded up, placed in the bag and the bag is closed. In this construction, the belt is located close to the machine gun and is no deeper than the bottom plate of the machine gun when shooting from a bipod. The nylon bag and all of its fittings are much lighter than an ammunition crate, and the center of gravity lies at most six inches to the side of the machine gun, which is comparable with the lateral position of the center of gravity when a cartridge belt alone is hanging down from the side of the weapon. This bag also may be used in a universal machine gun when an ammunition loader is not always available, as described above, and the cartridge belt is, thus, hanging down and can get caught in the terrain and the like.

However, this belt bag also has disadvantages. When the belt bag is completely full, the belt bag at most can rest only slightly against the machine gun, if at all, because the belt could otherwise be clamped or caught through the bag. Thus, a special, almost vertical, transition between the cartridge entrance of the machine gun and the bag is required so that the belt bulging towards the two sides does not rest against the machine gun. In addition, this transition must be longer depending on the size of the belt. Because the belt in the transition mainly moves vertically upwards, lateral space is also needed for the diversion of the belt. Thus, center of gravity of a filled belt bag is moved away from the gun to the side, which, as stated above, is undesirable.

Another important disadvantage of prior belt bags is the fact that the opening where the belt leaves the bag faces upwards and is unprotected. Thus, dirt can get into the bag and soil the belt. The bag has a small opening on the bottom for drainage, but this opening usually gets plugged with dirt rather than contributing to its removal. Thus, the risk of contamination from dirt, which is already rather high when using machine gun belts, is increased drastically.

DETAILED DESCRIPTION

Figure 1:
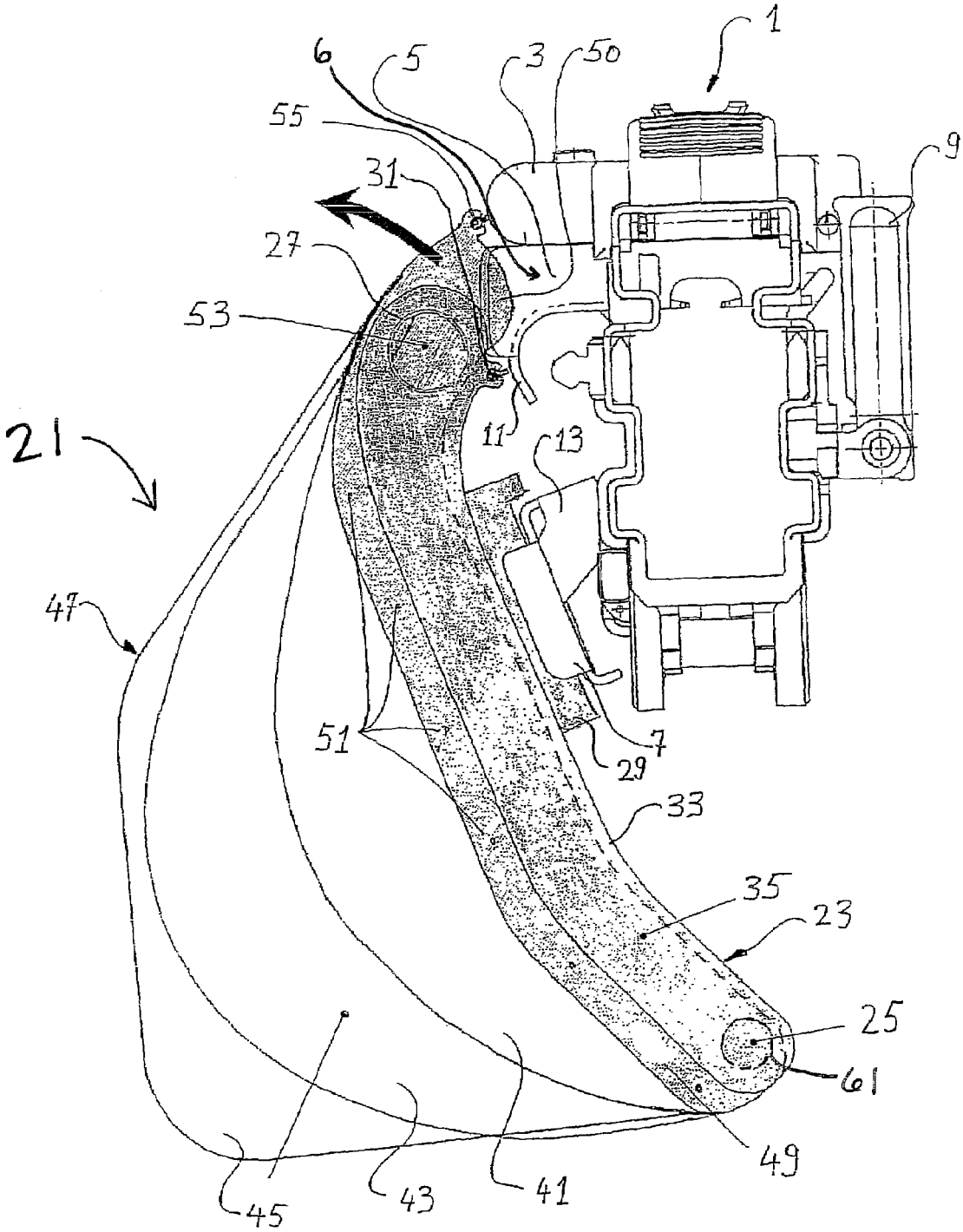
FIG. 1 is a cross-sectional view of an example firearm from behind with an example belt bag attached.

Throughout this description, it is assumed that a firearm with a belt bag properly attached may be held in a firing position in which the horizontal runs along the bore axis, the handle of the firearm is pointed downward and the ammunition is fired in the forward direction. All orientative and directional terms are referenced from this position. In addition, throughout this specification a "firearm" is mentioned, the intent is a weapon that may include a cartridge belt, which can be understood generally as a machine gun, hand gun, even if it is permanently mounted on a gun carriage, submachine guns, heavy machine guns, light machine canon, automatic grenade launchers or the like.

This disclosure relates generally to belt bags for firearms, for example, machine guns. An example belt bag, as described herein, includes two bag components coupled together via a hinge. The two bag components may be firmly locked together when in use and form the example belt bag. However, the two bag components may be pivoted apart into a reloading position to present a loading, or re-feed area. One of the bag components may be formed of a rigid material and may be attached to the firearm.

FIG. 1 shows a firearm 1 to which a belt bag 21 is coupled. The firearm 1 may be, for example, a universal machine gun, MG1, or any other type of weapon. Interior components of the firearm, such as a barrel, are not the focus of this disclosure and are not shown here for the sake of simplicity. Only the loading lever 9 located on the right side is shown, to elaborate on the depiction of the firearm 1.

As shown in FIG. 1, the top side of the firearm 1 has a feeder cover 3, which mainly runs horizontally when in use and may be folded upwards and forwards for loading. A horizontal belt feeder passage or shaft 5 is located on the left below the feeder cover 3. The feeder shaft 5 is open on the left at the belt intake opening 6, which leads to feeder catches (not shown) toward the right. The feeder shaft 5 extends downwards by a feeder table 11, which is rounded on the outside, and which guides an incoming cartridge belt (not shown).

During loading, the loading lever 9 is moved backward and forward again, to open the feeder cover 3. The cartridge belt may then be inserted or pushed to the right up to a stop (not shown) on the feeder table 11, and the feeder cover 3 may be closed again. The firearm 1 is now ready to be fired.

A dove tail arrangement 7 is located on the left side of the firearm 1 and runs diagonally from the top to the bottom and is coupled to the firearm 1 via a fixed bracket 13. The dove tail arrangement 7 and the bracket 13 are coupled to the housing of the firearm 1 by, for example, a weld.

The belt bag 21 has a rigid bag component 23 and one or more flexible bag components 41, 43 or 45. The rigid bag component 23 has a wall 33, from which a vertical edge 35 extends on both sides. A dove tail counter-arrangement or counter-bracket 29 is arranged on the wall 33 of the rigid component 23. When the counter bracket 29 is coupled to the bracket 13, a lower sealing lip 31 that is arranged on an upper end of the wall 33, seals with the feeder shaft 5 as described in greater detail below. The vertical edges 35 each have an opening 25, 27 on the top and bottom. The openings 27, 25 are arranged coaxially on the top and bottom. Overall, the rigid bag component 23 is designed such that the wall 33, which has a bent contour as shown in FIG. 1, extends from the feeder table 11 to below the firearm 1, wherein the bottom of the firearm 1 is at about the middle of the belt bag 21, where the dove tail counter-bracket 29 is coupled to the dove tail arrangement 7. The dove tail counter-bracket 29 thereby forms a massive or hollow core, while the dove tail arrangement 7 forms the outside and may be made of, for example, sheet metal.

The flexible bag component 41, 43 or 45 may include a cloth sack 47, which may be, for example, made of nylon fabric. The flexible component 41, 43, or 45 is fastened on the edge to a frame 49 using any mechanical or chemical fasteners such as, for example, rivets 51. The different bag components 41, 43, or 45 shown in FIG. 1 correspond with different belt lengths. Depending on the use of the firearm 1, varying belt lengths of, for example, 50, 100, 150 or 200 shots may be used. Furthermore, though the bag components 41, 43, or 45 are described as flexible components, in other examples, the bag components 41, 43 or 45 may not be provided with a cloth sack 47, but rather with rigid or semi-rigid shell elements. Also, all components coming in contact with ammunition may be lined or coated with sound-damping material for the reduction of transport noises.

The frame 49 may be formed from plastic and includes pins 61 on the bottom on both sides that are positioned in the openings 25. There are also bolts on the top side that form push buttons 53. The frame 49 extends over the push buttons 53 right up to the feeder cover 3. An upper sealing lip 55, which seals the feeder cover 3 such that the feeder cover 3 (under the effect of the seal) may be opened, is also fastened at the top. The push buttons 53 engage coaxially in the push button openings 27 of the rigid bag component 23.

To load the firearm 1 for shooting, the bag 21 with the dove tail counter-arrangement 29 may be inserted from above into the dove tail arrangement 7. The two push buttons 53 are pushed in or otherwise actuated and the flexible bag component 41, 43 or 45 with the frame 49 is pivoted about the pins 61 the openings 25 until the upper edge of the flexible bag component 41, 43 or 45 with the upper sealing lip 55 are no longer sealed and are free to hang down. The feeder cover 3 is opened, the belt is inserted, the belt is placed in tabs into the flexible bag component 41, 43, 45, the feeder cover 3 is closed again, and the belt bag 21 is closed. The firearm 1 is now operational and shooting may begin.

For reloading, the bag 21 is just opened, unfolded, and another belt section is inserted or hung on the remaining portions of the existing belt. Should there be no time to close the bag, or if the bag 21 is otherwise left open, the firearm 1 still may be shot because the feeding of the belt is in no way hampered by an opened bag. The opening of the feeder cover 3 also may take place unhindered, depending on whether or not the bag 21 is closed.

However, if the bag 21 and the feeder cover 3 are closed, the two sealing lips 55 and 31 on the top and bottom as well as lateral flanks 50 of the frame 49 from the side completely seal the opening of the belt feeder shaft 5. Consequently, the belt is free from environmental influences that, as described above, can dirty or otherwise soil the belt. Meanwhile, the firearm 1 remains operational and a shot may be fired at anytime.

As stated above, the rigid bag component 23 and the flexible bag component 41, 43, or 45 are coupled via a hinge and may be may be pivoted apart into a reloading position to present the belt feed and reloading area. However, the rigid bag component 23 and the flexible bag component 41, 43, or 45 also may be firmly locked together when in use and form the example belt bag 21. When in use, the example belt bag 21 may be coupled to the firearm 1 so the opening of the belt bag 21 is adjacent to the belt feeder shaft 5 of the firearm 1, which, as stated above, protects the ammunition in the belt from environmental hazards.

Further, as stated above, the belt bag 21 may not include only rigid material. Rather in some examples, the belt bag 21 is more of a semi-rigid case. Also in some examples, the construction or design of the belt bag 21 at the portion facing the firearm 1, i.e., the rigid bag component 23 may not be deformable according to the position and movement of a folded belt inside the belt bag 21. In addition, the term "bag" is used because the cartridge container (i.e., the belt bag 21) resembles a bag, regardless of the materials used to form the belt bag 21.

One of the advantages of the example belt bag 21 with the rigid bag component 23, is that the bracket 13 may be arranged in one of a plurality of locations without requiring the belt bag 21 to be moved to another position. Therefore no rigid mounting part is required as described in U.S. Pat. No. 6,675,693. Thus, the space required by a mounting part is not needed, and the belt bag 21, therefore, may be coupled directly to the firearm 1 with the opening of the belt bag 21 on the belt intake opening 6 of the firearm 1. In addition, a bag, e.g., the belt bag 21, that includes the rigid component 23 may rest directly against the firearm 1 without causing or allowing a belt contained in the belt bag 21 from catching or becoming hooked on a portion of the firearm 1 that may cause the bag to protrude inward. Finally, inclusion of the rigid bag component 23 also enables the belt bag 21 to be wider than a bag made from entirely flexible components without hanging down too far.

The weight of the rigid bag component 23 is not much different from the weight of a corresponding part of a cloth bag, in particular because no surrounding frame is generally required for the rigid bag component 23, while such additional components are absolutely required with cloth bags.

In addition, the semi-rigid belt bag 21 (i.e., bag combining the rigid component 23 and the flexible component 41, 43 or 45) enables the example belt bag 21 to be coupled higher and closer to the firearm, compared with a corresponding cloth bag. Thus, operating safety of the firearm 1 is increased while the weight remains largely the same.

Further, to achieve less weight with higher stability, the rigid bag component 233 may be made, for example, of a plastic, which may be injection-molded. The use of plastic also allows to fast and simple creation of complicated shapes. However, it also is possible to produce the rigid bag component 23 from other rigid materials such as, for example, sheet metal. Use of sheet metal may only slightly increase the resulting weight.

Because of the large quantity of ammunition that may be needed and used by the firearm 1 and the desire to increase the ease of reloading, the belt bag 21 has a center of gravity that laterally lies very close the firearm 1. In addition, the center of gravity of the belt bag 21 does not adversely affect operation of the firearm 1 so that in some examples, the belt bag 21 also may be used with a bipod, which may include, for example, that the belt bag 21 reaches the ground if necessary. In addition, the weight of the belt bag 21 is, thus, very low. Further, the risk of contamination from dirt also is drastically reduced.

Both the rigid bag component 21 and the flexible bag component 41, 43, or 45 may be made of plastic and coupled using a coating hinge such as, for example, the coating hinges used with known cloth bags in which an opening is attached to the bag to allow water, which may have entered the bag during a rain, to drain from the bag. However, according to the illustrated example, the rigid bag components 23 and the flexible bad component 41, 43, or 45 may be swivel-mounted with the two pivot bearings 61 in the hinged area by the openings 25, as described above. The pivot bearings 61 may be formed via various components, including, for example, by the pins 61. In the illustrated example, the pins 61 are coaxial to each other, are formed on both sides of the rigid bag component 23 and extend inwardly towards each other, starting from the vertical edges 35. The vertical edges 35 may be projecting edges and also give the flexible bag component 41, 43 or 45, which engages in the vertical edges 35, sufficient rigidity so that the flexible bag component 41, 43, or 45 only needs to be rigid enough to encase a cartridge belt. Further, the flexible bag component 41, 43 or 45 may be pivoted to open and close like a cover around an axis of the two pins 61.

The configuration of the example described herein is not only more reliable and permanent than a coating hinge, but the flexible bag component 41, 43, or 45 may be easily exchanged or replaced with little effort by simply actuating the pins 61 in the pin openings 25 and/or the push buttons 53 within the push button openings 27.

In other examples, the belt bag 21 may be closed at the top (along the top of the upwardly projecting rigid component 23) and open at the bottom. That is, the push buttons 53 may be engaged in the push button openings 27 while the pins 61 are not engaged in the pin openings 25. In this example, it is possible to freely swivel-mount the firearm 1 directly over, for example, a manhole or a roof of a vehicle because the belt bag 21 may be attached above the belt intake opening 6 and feeder shaft 5. Though in other uses, it is preferred that the pivot bearings, i.e., pins 61, are attached on the bottom side of the rigid bag component 23. Further, as described and shown, the overall height of the firearm 1 is not increased by the belt bag 21 and, thus, the belt bag 21 does not impair either the silhouette of the firearm 1 or the unobstructed view over the firearm 1.

Furthermore, as described above, there are locking push buttons, i.e., the push buttons 53 located toward the top of the belt bag 21 in the push button opening 27 of the rigid bag component 23 are used to lock the top portions of the rigid belt component 23 with the flexible belt component 41, 43 or 45 in the so-called "over head fashion" or when the belt bag 21 is closed at the bottom as well. The engagement of the push buttons 53 in the push button openings 27 is a releasable engagement (e.g., the push buttons 53 and push button openings 27 may be disengaged during the reloading of another belt into the belt bag 21). Because the rotating axis of the hinged connection of the push buttons 53 between the rigid bag component 23 and the flexible bag component 41, 43 or 45 is located downward from the top of the firearm 1 and toward the middle of the firearm 1, and because the top side of the belt bag 21 is positioned laterally next to the belt intake opening 6 and feeder shaft 5 of the firearm 1, all that needs to be done to open the belt bag 21 is to grab the top side of the belt bag 21 and simultaneously push in the push buttons 53 with one hand. The outer bag component may fold downward while continuing to be held in the grasping hand. Consequently, it is possible to open the belt bag 21 quietly to lengthen the belt, to check the loading state, etc. for example. In addition, the operation of opening and/or closing the belt bag 21 may occur in the same manner from the rear (e.g., deployment in the field) or from below (e.g., deployment in a vehicle).

Though the flexible bag component 41, 43, or 45 is light may be made, for example, of a cloth or a plastic film, the flexible bag component 41, 43, or 45 requires a frame. Thus, the rigid bag component 23 if made of moldable plastic is almost as light as the flexible bag component 41, 43, or 45. However, in some example, the hinged flexible bag component 41, 43 or 45 also may be made of a rigid material. In such an example, the belt bag 21 forms a firm belt housing, but which is shaped like a bag and contains a belt. Thus, an example belt bag 21 in which the flexible bag component 41, 43, or 45 is actually a firmer component is still referred to as a "belt bag" here.

However, as also described herein, the hinged flexible bag component 41, 43, or 45 also may be formed of a flexible material so the belt bag 21 forms a pocket. The pocket may or may not be resistant to deformation. However, in the example, the belt bag 21 may be folded when the belt bag 21 is empty, in which case, the belt bag 21 takes up less storage space than the prior example where the flexible bag component 41, 43, or 45 forms a rigid belt bag.

To keep the belt from rattling during deployment, the rigid bag component 23 may be provided with a sound-absorbing material on at least a portion of the inside surface. Any interior surface of the rigid bag component 23 that touches the belt may thereby be flocked or covered with cloth or the like. This prevents the belt bag 21 from sounding like a bell when the belt hits against the rigid bag component 23. In addition, the cloth or the flocking may be coated or equipped for reduced friction to ensure that the belt glides in the bag lightly and without obstruction. The coating of the belt is thereby pressed together slightly so that the sections of the belt are not loose and, thus, cannot bang against each other such as, for example, when the belt bag 21 is full.

As stated above the flexible bag component 41, 43, or 45 is interchangeable. Thus, other bag components of varying dimensions and materials may be interposed with the flexible bag component 41, 43, or 45. Thus, it is not only possible to exchange bag components made of rigid materials, which may be adjusted for the particular firearm, but also to replace the outer-lying bag components according to the intended deployment. For example, large bag components may be used to house long belts for built-in firearms, the feeding or reloading of which is inaccessible during deployment. Alternatively, normal bag components that are easily carried maybe used for light infantry firearms.

As discussed herein, it may be practical to stamp and bend the rigid bag component 23 out of, for example, sheet metal. However, the rigid bag component 23 also may be made from a molded plastic. When plastic, the rigid bag component 23 has a low weight, high corrosion resistance, and easy and simple processing and is inexpensive yet durable. Consequently, weapons that include the belt bag 21 do not require different components for peace-keeping and war time deployments because the "peace-keeping design" is already optimized based on, for example, the principles of cost-effectiveness.

As described above, the example firearm 1 with the example belt bag 21 may have the same basic structure as any normal firearm, which is provided with a device for feeding in ammunition by means of a belt such as, for example, the German Machine gun 42 (MG42), which was the German Federal Armed Forces' only universal machine gun until just recently. In addition, the example firearm 1 may also be a modern machine gun with a smaller caliber such as, for example, a weapon constructed for the .223 Remington cartridge.

In the illustrated example, the bracket 13 is coupled to the firearm 1, for example, below the belt intake opening 6 and belt feeder shaft 5. In addition, the rigid bag component 23 has a counter-bracket 29 that is complementary to the bracket 13 on the outside (i.e., complementary to the dovetail arrangement 7 on the bracket 13, as noted above). Though, U.S. Pat. No. 6,675,693 describes the use of a bracket associated with the coupling of a cartridge bag onto a machine gun, the present example also includes the coupling of the counter bracket 29 directly onto the belt bag 21 and in particular to the rigid bag component 23. Thus, the belt bag 21 is directly coupled to the firearm 1 at this location, whereas the conventional bags hang freely at this spot leading to, for example, problems such as those discussed above. In addition, the example belt bag 21 is readily and effortlessly attached to the firearm 1 because this point of engagement between the bracket 13 and the counter bracket 29 is rigid. Thus, the belt bag 21 cannot be deformed during installation on the firearm 1, as would be unavoidable with the conventional bags.

The lower sealing lip 31 is provided on the top portion of the belt bag 21 to couple the belt bag 21 and, in particular, the top portion rigid bag component 23 to the belt intake opening 6 and belt feeder shaft 5 when the rigid bag component 23 is coupled to the firearm 1. Thus, the rigid bag component 23 includes the lower sealing lip 31 which may be made, for example, of flexible material on its top side, which lies tight or substantially sealingly engages against the bottom side of the belt intake opening 6 and feeder shaft 5. In addition, the top side of the pivotable flexible bag component 41, 43, or 45 includes the upper sealing lip 55, which may be made of, for example, a flexible material, which lies tight or sealingly engages against the top side of the belt intake opening 6 and feeder shaft 5 when the counter-bracket 29 is coupled to the bracket 13, and the rigid bag component 23 is locked together with the flexible bag component 41, 43, or 45. The upper and lower sealing lips 31, 55 may be made, for example of an elastomer such as rubber or a heat-resistant silicon.

Finally, as described above, the pivotable flexible bag component 41, 43, or 45 also includes the projecting flanks 50 on both sides, which overlap and protect the belt intake opening 6 and feeder shaft 5 on both sides.

The upper and lower sealing lips 31, 55 and the lateral flanks 50 cooperate in a reinforcing manner to establish a seal between the belt outlet opening of the belt bag 21 and the belt intake opening 6 of the firearm 1. This seal prevents the penetration of dirt and dust, but also the penetration of spraying water or rain, so that the belt is largely protected from external influences. Thus, the seal between the belt bag 21 and the firearm 1 is as good as the seal of weapon with a magazine. Foreign bodies, typically make their way into a firearm during belt infeed, are now blocked, which increases the reliability of the firearm, 1 in particular when the firearm 1 is always loaded but rarely used.

As described above, the belt bag 21 extends not only downwards but also to the side under the firearm 1. The rigid bag component 23 may rest entirely on the firearm 1 without the risk of the belt getting caught in the belt bag 21. In some examples, the rigid bag component 23 extends laterally and under the firearm 1 such that the firearm 1 extends over the middle of the belt bag 21. Thus, the center of gravity of the belt bag 21 when filled is about at the actual the firearm 1 and, in an extreme case, lies below the firearm 1. Therefore, a continuous change of the lateral load as a result of a changing belt weight is minimized during shooting. It is thus possible to eliminate the need to have an ammunition loader available to feed or reload the belt due to an adjusting firearm because the change in the center of gravity is minimized due to the use of the cartridge belt. It is thus possible to eliminate the ammunition loader entirely in many situations.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm including a belt bag, comprising:

a bag including a first bag component and a second bag component, wherein at least one of the first bag component or the second bag component includes a rigid portion, wherein the first bag component and the second bag component are releasably coupled and pivotable with respect to one another between an open position and a closed position, and wherein the first bag component and the second bag component are coupled via a lockable push button at a top side of the first bag component and via a pivot at a bottom side of the first bag component;

a bracket coupled to the firearm below a belt intake opening of the firearm for engagement with the belt bag;

a counter-bracket coupled to the belt bag for engagement with the firearm, wherein the counter-bracket is coupled to the rigid portion of the belt bag, and wherein the counter-bracket is complementary to the bracket; and a sealing lip coupled to the belt bag to sealingly couple the belt bag to at least a portion of the firearm.

2. The firearm as defined in claim 1, wherein the rigid portion of the belt bag includes the sealing lip on a top portion of the rigid portion of the belt bag, wherein the sealing lip includes a flexible material, and wherein the sealing lip is sealingly coupled to a bottom of the belt intake opening when the counter-bracket and the bracket are engaged.

3. The firearm as defined in claim 1, wherein the belt bag further includes a pivotable portion, and wherein the pivotable portion includes the sealing lip on a top portion of the pivotable portion of the belt bag, wherein the sealing lip includes a flexible material, and wherein the sealing lip is sealingly coupled to at least one of a top side of the belt intake opening or to a feeder cover when the counter-bracket and the bracket are engaged and the pivotable portion of the belt bag and the rigid portion of the belt bag are locked.

4. The firearm as defined in claim 3, wherein the pivotable portion of the belt bag further includes flanks coupled to the belt intake opening to protect the belt intake opening.

5. The firearm as defined in claim 1, wherein the rigid portion extends at least partially under the firearm.

6. A belt bag for use with a firearm including a belt intake opening, the belt bag comprising:

a first bag component, which extends in an upright direction when coupled to the firearm; and a second bag component, wherein the first bag component and the second bag component are releasably coupled and pivotable with respect to one another between an open position and a closed position, wherein the first bag component and the second bag component are coupled via a lockable push button at a top side of the first bag component and via a pivot at a bottom side of the first bag component, wherein the second bag component is removable and interchangeable with a third bag component, and wherein an opening of the belt bag is substantially sealingly engaged with the belt intake opening.

7. A belt bag for use with a firearm including a belt intake opening, the belt bag comprising:

a first bag component; and a second bag component, wherein the first bag component is made of a rigid material and, when coupled to the firearm, extends in an upright direction, wherein the first bag component and the second bag component are releasably coupled and pivotable with respect to one another between an open position and a closed position, wherein in the open position is a reloading position, and wherein the first bag component and the second bag component are coupled via a lockable push button at a top side of the first bag component and via a pivot at a bottom side of the first bag component, wherein the second bag component is removable and interchangeable with a third bag component, and wherein an opening of the belt bag is coupled to the firearm directly adjacent to the belt intake opening.

8. The belt bag as defined in claim 7, wherein the second bag component is made of a rigid material.

9. The belt bag as defined in claim 7, wherein the second bag component is made of a flexible material.

10. The belt bag as defined in claim 7, wherein the first bag component includes a sound-damping material.

11. The belt bag as defined in claim 7, wherein the third bag component has dimensions different than the second bag component.

12. The belt bag as defined in claim 7, wherein the first bag component is made of a molded plastic.

13. The belt bag as defined in claim 1, wherein the second bag component supports an ammunition belt.

14. The belt bag as defined in claim 1, wherein a portion of the first bag component extends directly under the firearm.

* * * * *